US011585058B2

(12) United States Patent
Hodgson

(10) Patent No.: US 11,585,058 B2
(45) Date of Patent: Feb. 21, 2023

(54) FLOOD DEFENCE SYSTEM WITH LOW ENVIRONMENTAL IMPACT

(71) Applicant: Peter Andrew Hodgson, Bakewell (GB)

(72) Inventor: Peter Andrew Hodgson, Bakewell (GB)

( * ) Notice: Subject to any disclaimer, the term of this patent is extended or adjusted under 35 U.S.C. 154(b) by 0 days.

(21) Appl. No.: 17/458,993

(22) Filed: Aug. 27, 2021

(65) Prior Publication Data

US 2022/0064887 A1 Mar. 3, 2022

(51) Int. Cl.
*E02B 3/04* (2006.01)
*E02B 3/10* (2006.01)

(52) U.S. Cl.
CPC ..... *E02B 3/041* (2015.09); *E02B 3/10* (2013.01)

(58) Field of Classification Search
CPC ... E02B 3/02; E02B 3/041; E02B 3/10; E02B 7/18
See application file for complete search history.

(56) References Cited

U.S. PATENT DOCUMENTS 1,958,354 A * 5/1934 Stephens ..... F04F 5/10 417/198
2,762,202 A * 9/1956 Ponsar ..... E02B 7/18 261/DIG. 75
4,091,624 A * 5/1978 Steinke ..... E02B 8/045 405/96
4,573,877 A * 3/1986 Baumberg ..... F04F 5/00 417/198
5,152,242 A 10/1992 Bradley
6,334,736 B1 * 1/2002 Johnson ..... E02B 3/108 405/114
2002/0043283 A1 * 4/2002 Bouwkamp ..... G05D 7/0186 137/251.1
2003/0039512 A1 * 2/2003 Bethune ..... E02B 9/00 405/75
2009/0020163 A1 * 1/2009 Colton, Sr. ..... E02D 3/10 137/147
2011/0070027 A1 * 3/2011 Hurley ..... E02B 11/00 405/41

(Continued)

FOREIGN PATENT DOCUMENTS

WO WO-2005098143 A1 * 10/2005 ..... E02B 7/18

OTHER PUBLICATIONS

GB (UK IPO) Search Report and Examination Report dated Oct. 2, 2020 for Application No. GB2013575.2 (3 pages).

*Primary Examiner* — Benjamin F Fiorello

(57) ABSTRACT

A flood barrier for protecting the environment having a venturi type effect pumping means not requiring external power, the flood barrier comprising a wall and a pump for drawing water across the barrier from a first side to a second side. The wall configured to provide a barrier preventing movement of water from the first, drain, side to the second, tributary, side, of that wall. The barrier further comprising a pipe traversing the wall for transferring water between the two sides of the wall the pipe being terminated in the first side of the wall at a venturi effect pump, the pump being feedable with water from the drain through a conduit inlet so as to create suction in the pipe for drawing water through the pipe from the second side of the wall to drain water from the second to the first side of the wall.

6 Claims, 4 Drawing Sheets

(56) References Cited

U.S. PATENT DOCUMENTS

| | | | | |
|---|---|---|---|---|
| 2015/0247300 | A1* | 9/2015 | Seo | E02B 8/085<br>405/83 |
| 2021/0148327 | A1* | 5/2021 | Anteau | F03B 17/04 |

* cited by examiner

FLOOD DEFENCE SYSTEM WITH LOW ENVIRONMENTAL IMPACT

RELATED APPLICATIONS

This application claims priority to GB Patent Application Number 2013575.2, filed on 28 Aug. 2020, to Applicant Peter Andrew Hodgson, which is incorporated by reference herein.

TECHNICAL FIELD

The present invention relates to a flood defense system in which a water height differential between water drainage, such as a river, and incoming water, such as a stream, which may be reversed under flood conditions, is overcome so as to continue placing incoming water into drainage.

BACKGROUND

Flood defenses are required to not impede normal drainage and are preferably passive under normal conditions, therefore not requiring maintenance. Under flood conditions they should be enable excess water to be channeled and drained away but this may not be possible if the height differential between incoming and drained water is not present.

A known problem is that surface water drainage from upland areas can give rise to swollen rivers downstream which may need to be contained by a flood defense barrier. The problem then arises that incoming water streams also downstream cannot effectively drain into the river since the river can be at a higher level than the surrounding area. As a result, localised flooding downstream can occur not necessarily because of undue excess local water, although this may also be a problem, but simply because the height differential between the tributaries coming into a drain or river do not have a, or have a negative, height differential. This can give rise to one of the significant problems in flood situations in which floodwater stops soil drainage from occurring and hence soil effluent becomes mixed with floodwater and gives rise to significant property damage through spoilage.

Tributary water can be pumped into a drain so as to actively overcome a water height differential and permanent installations to achieve this are conventional but are relatively expensive and the installation of suitable power to installations in remote areas add significantly to cost and complexity. There is therefore a need for a pumping means to drain a tributary into a drain when a suitable water height differential to allow incoming water to fall is not present under flood conditions but where it is not normally required. A simple, robust and cost-effective solution is required with low management requirements and suitable for automatic occasional use.

SUMMARY

A preferred form of flood defense is a barrier which incorporates pumping means to take water from a tributary to a drain and more preferably is capable of transferring water from a tributary to a drain without pumping when not under flood conditions.

It is also preferable that pumping is energy efficient both to reduce maintenance and the reduce its environmental impact.

The present invention provides: a flood barrier having pumping means, the flood barrier comprising a wall and a pump for drawing water across the barrier from a first side to a second side, the wall configured to provide a barrier preventing movement of water from the first, drain, side to the second, tributary, side, of that wall, the barrier further comprising a pipe traversing the wall for transferring water between the two sides of the wall the pipe being terminated in the first side of the wall at a venturi effect pump, the pump being feedable with water from the drain through a conduit inlet so as to create suction in the pipe for drawing water through the pipe from the second side of the wall to drain water from the second to the first side of the wall.

As will be appreciated, the flow of water in the drain acts to provide a suction effect on the pipe thus drawing water from the tributary to the drain and since a suction effect is present then the height of the water in the drain can be higher than that in the tributary to the extent that the rate of flow provides sufficient suction. The flood barrier is configured on installation to provide the required level of suction in comparison to the flow rate of the drain and the high differential.

DETAILED DESCRIPTION OF THE DRAWINGS

The present invention will now be illustrated with reference to the following figures, showing the invention in its various embodiments in schematic form at, and in which.

DETAILED DESCRIPTION

Figure 1:
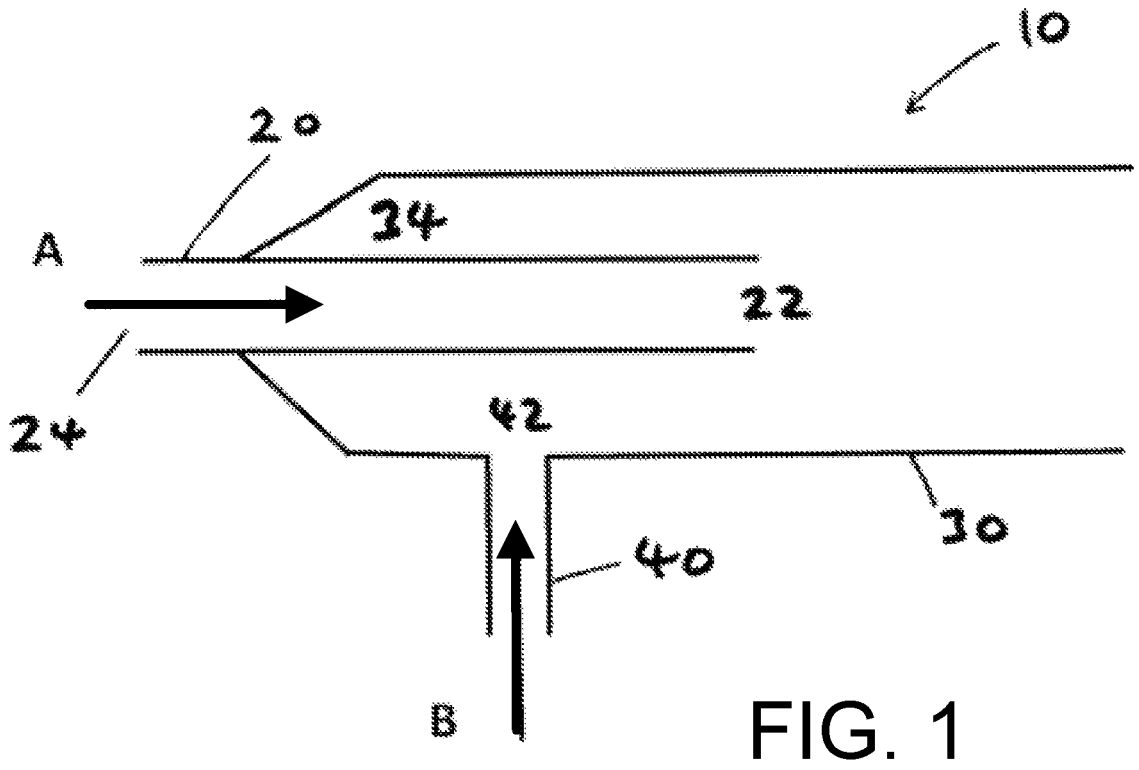
FIG. 1 shows a cross-sectional view of a venturi pump on the present invention.

Like numerals refer to like features in the figures. These include:

A water coming in through the inlet conduit
B water coming in through the pipe
10 venturi pump
20 inlet conduit
22 inlet conduit outlet
24 inlet conduit inlet
30 outlet conduit
32 outlet conduit outlet
40 pipe
42 pipe outlet
44 pipe inlet
46 raised portion of pipe between inlet and outlet of pipe
62, 64 pump supports attached to first wall of barrier
100 flood barrier
102 first side of flood barrier
104 second side of flood barrier
108 base upon which the flood barrier is mounted
110 drain

120 tributary

130 wall

140 optional water inlet port for ballasting the wall 130 when hollow.

142 optional water inlet/outlet port for water ballasting the wall 130 when hollow.

In a preferred installation the inlet conduit of the pump is fed from the drain such that the inlet only becomes accessible underfoot conditions when flow rates are relatively high and thus the suction effect achieved becomes significant. For example, a flow rate of 1 m/s in a river can provide, say 30 cm of water (the pressure required to raise a column of water by 30 cm) of suction pressure even in a relatively inefficient venturi effect pump.

In the present invention, preferably (either together or independently): the pipe traversing the wall, the inlet conduit to the pump, which is larger than the pipe, and the outlet conduit from the pump, which is larger than the inlet conduit, preferably do not have any constrictions. Preferably there is no constriction within the pump between the inlet and the outlet of the conduit.

When the venturi effect pump is outside the flood barrier first wall, which is useful when fitting to an existing flood defense wall or similar drain wall, the outlet of the outlet conduit may be reduce in size but to no less than the outlet of the inlet conduit. This facilitates creating suction in the venture effect pump but still enables the largest accessible debris to exit. The inlet and the outlet preferably carry a screen to reduce the ingress of debris. Preferably the inlet to the overall conduit is preferably angled, this arrangement gives a degree of self-cleaning to the screen, such as a grille or mesh, since the water passes over it obliquely. Whilst superficially this is less efficient than an aperture perpendicular the flow in the drain (e.g. river) the volume of water in flood conditions and the self-cleaning of the screen more than offset this. An angle of the inlet to the main axis of the pump is preferably in the range 5 to 30°, preferably from 10 to 20° for optimal inlet efficiency and self-cleaning, in this configuration the angle does not reduce the efficiency of water ingress but does make the inlet more open to damage from collision with debris.

This form of venturi effect pump is unconventional as the venturi effect is best exemplified where there is a constriction in the conduit. However, for the purposes of the present invention provided that the outlet conduit is larger than the inlet conduit and the changing diameter of the conduit provides sufficient suction to draw water from the pipe so as to provide suction. The significant advantages are that when there is no constriction in the pipe or the conduit part or parts the likelihood of blockage by debris is low. This is significant as in the present application of flood defense there is a high likelihood of debris, soil and other detritus in the water and any constriction is rapidly blocked. Most preferably one or more of and preferably all of, the pipe, the inlet conduit and the outlet conduit (which may themselves be in the form of pipes) taper outward from their inlet to the outlet ends, thus further reducing the potential for blockage. As will be appreciated that such a taper must also fulfil the requirement that at the outlet end of the inlet conduit the inlet end of the outlet conduit and the outlet end of the pipe the above ratio of sizes is present. The outward taper is preferably present, for the inlet conduit between its inlet and the venturi pump, but not within the pump. The outward taper is preferably present along the whole length of the outlet conduit. These features maintain better pump efficiency. The taper is preferably in the range 2 to 10%, larger tapers reduce water flow efficiency and do not significantly reduce blockage further.

In referring to the size of the pipe and the conduit this is a reference to the cross-sectional area of the pipe/conduit perpendicular to its principal axis. For example, if the pipe his cylindrical then the size of the pipe is the area of the circle defined across the cylinder. The pipe is preferably cylindrical, or at least predominantly cylindrical. The inlet conduit and the outlet conduit are preferably cylindrical. A 2% taper means a 2% increase in cross-sectional area over a given length. The conduits and the tubes are preferably tapered and circular in cross section to avoid blockage and build-up of residue.

In a preferred embodiment, the first side and the second side of the flood barrier are separated by an internal area; and the first side of the wall defines at least one pair of ports, an upstream port and a downstream port. An overall conduit extends between each of the at least one pair of ports; the inlet conduit having its inlet at the (as installed) upstream port and the outlet conduit having its outlet at the (as installed) downstream port, with the two conduits making up the overall conduit, their respective other ends being terminated in the venturi pump. In this arrangement the inlet to the overall conduit is preferably angled outward of the first wall to facilitate water ingress. The inlet and the outlet preferably carry a screen to reduce the ingress of debris, this arrangement gives a degree of self-cleaning to the screen, such as a grille or mesh, since the water passes over it obliquely. Whilst superficially this is less efficient than an aperture perpendicular the flow in the drain (e.g. river) the volume of water in flood conditions and the self-cleaning of the screen more than offset this. An angle of the inlet to the first wall is preferably in the range 5 to 45°, preferably from 10 to 30° for optimal inlet efficiency and self-cleaning.

In an alternative embodiment the venturi pump is affixed to the external; first side (face) of the wall and is in line with the main axis of flow of the drain (e.g. pointing up and down river) with the entrance of the entrance conduit facing perpendicular to that axis.

Wherein the conduit is housed within the internal area the venturi pump is also housed therein. This protects both pump and conduit.

The pipe having an inlet on the second side and an outlet on the first side may be configured to arch up between those ends to prevent water transfer under gravity. However, siphonage is still possible and so as to utilise this the inlet is preferably higher than the outlet, therefore siphonage into the pump is possible and aids transfer when the pump is operational and can also facilitate transfer from the tributary to the drain even when the pump is not operational (low drain water level). However, the reverse prevented by providing the top of the pipe being placed in use above the highest expected drain water level. Alternatively, a non-return valve may be used.

In the present invention the pump is referred to as venturi effect pump. Should it be deemed that the pumping effect in any given embodiment is not caused by the venturi effect then this is not to be taken as limiting. As can be seen, a significant advantage of the present invention is that it requires no moving parts and therefore provides low maintenance and durability during potentially long terms of passivity between flood events.

The flood barrier of the invention may incorporate multiple pumps but is described in relation to a single pump. Multiple pumps can be placed in a staggered arrangement at multiple heights so as to take effects at increasing levels of flooding. Higher place pumps will require a lower loop in the pipe for drawing in water from a tributary and are therefore more efficient at high flood levels where high flow is most required.

The pump is configured by the junction of the inlet conduit with the outlet conduit, the inlet conduit being smaller than the outlet conduit and therefore there is a reduction in pressure in water traversing from one to another, in this region the outlet of the pipe Is placed so that the reduction pressure can be alleviated by fluid entering from the pipe into the outlet conduit in which the outlet of the pipe needs. In a first configuration (FIG. 1, FIG. 3) the outlet of the pipe is joined to a wall of the outlet conduit proximate to its end remote from the outlet end and in which very approximate to the end the outlet of the inlet conduit extends so is to provide a cylindrical ring into which the pipe feeds. This has the advantage that detritus entering through the inlet conduit cannot under normal circumstances block the outlet of the pipe.

In a second configuration (FIG. 4) the outlet of the pipe exits centrally in the outlet conduit proximate to its end remote from the outlet of the outlet conduit in a region into which the outlet of the inlet conduit feeds. This configuration also reduces blockage as the outlet end of the pipe is configured to be parallel with the axis of the outlet conduit but is less advantageous as the pipe protrudes and is liable to damage through impact from detritus.

In a further configuration, (FIG. 3 variants) the inlet conduit is not symmetrically entering into the outlet conduit but is offset, this produces the largest volume into which the pipe may feed and reduces blockage but less efficiently creates suction due to the water coming through the inlet conduit expanding into the outlet conduit.

The flood barrier may be configured such that it is portable so that it may be erected only during times of flooding. For example, as an insertable section in a flood wall whether permanent or itself made of portable sections. This letter combination is preferred as drain can be formed in situ as is convention in ad hoc flood defenses and the unpowered (i.e. not externally powered) pumping of the present invention means that it can be placed optimally at points of higher flow without regard to the availability of a power supply. Similarly, ad hoc defenses are often imperfect and require so degree of pumping to properly contain water from a drain.

The one or more pumps are configured to move water from the protected area to the flooded area (from the second to the first side). This provides the benefit that the flood barrier can make up for any leaks elsewhere in the barrier and prevent localised low-level flooding. Further the pump may rectify the fact that the flood barrier may have been erected at a time at which flood water has already reached the protected area. The one or more pumps therefore allow the flood barrier to be erected closer to the source of the flood water than a flood barrier that does not have a pump could be. The flood barrier may be erected in an area of low-level flooding and any flood water on the second side of the flood barrier will be pumped to the other side of the barrier. The present invention therefore allows for the area protected from flooding to be increased compared to flood barriers without pumps.

The pump derives power from the water flow, such as of floodwater, in the drain. This provides no environmental impact, particularly carbon emissions. This also provides the benefit that the pump of the flood barrier are self-powered by means that are integrated within the barrier itself. This removes the need for any external power supply for the pumps. This is particularly useful as power supplies, particularly electrical power distribution may be disrupted by flooding or for internal combustion engines where fuel delivery disrupted. Further, the power generated by is environmentally friendly as it is drawn from the flow of water.

In the present invention the concepts of drain and tributary are used. The tributary can simply be an area of water outside the drain and is not necessarily an identifiable tributary. However, placements will be optimal if cited at the location of a tributary. Similarly, the drain may simply be a flooded area bounded so as to be an area for drainage.

The present invention will now be described with reference to the drawings:

FIG. 1 shows a cross-sectional view of a venturi pump 10 of the present invention; water enters the pump 10 at A through the inlet conduit 20 and exits the outlet of the inlet conduit 22 into the inlet region 34 of the outlet conduit 30, the outlet conduit 30 being of larger size and thus water in region 24 is at a reduced pressure and as such moves down the outlet conduit towards the outlet of the outlet conduit 32. In doing so the pressure at the outlet of the pipe 42 reduces and the fluid in pipe 40 is drawn into the pump, this may be initially air but will then be followed by water, the height of the loop 46 of the pipe not being higher than that permitted by the vapour pressure of water.

Figure 2:
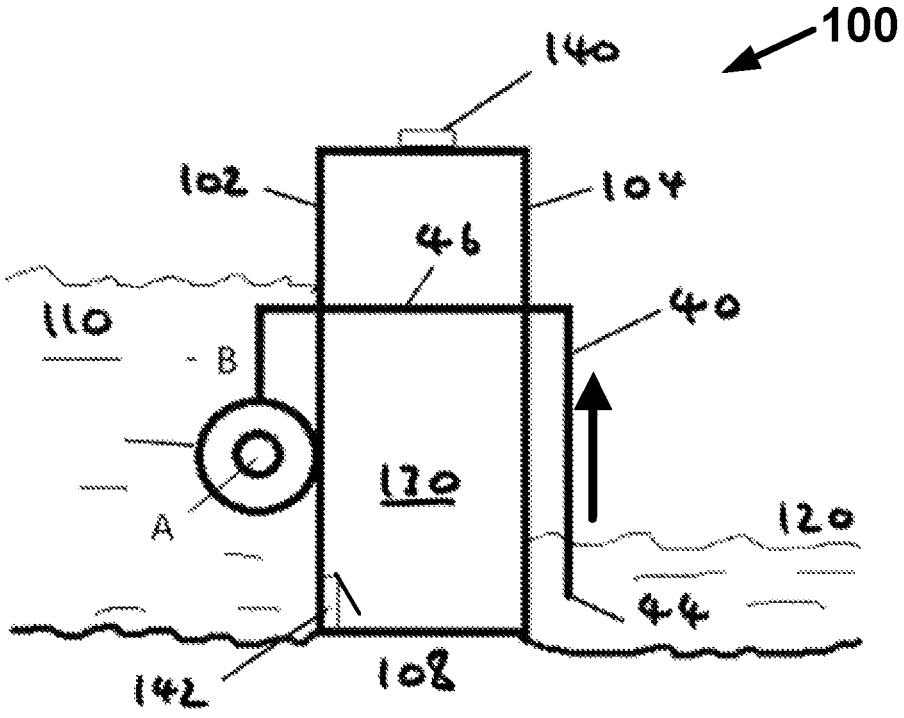
FIG. 2 shows a vertical cross-section through the flood barrier of the present invention.

FIG. 2 shows a vertical cross-section through the flood barrier 100 of the present invention; this comprises the physical barrier 130, such as a concrete block or steel sheet having a first side 102 and a second side 104, the first side being adjacent and forming a side of the drain 110 and the second side being adjacent to and forming a side of the tributary 120. In the embodiment depicted the pump 10 is attached to the first side 102. The pipe 40 traverses the barrier from the inlet 44 of the pipe to the outlet 42 (not labelled) of the pipe at B (see FIG. 1), this serves to deliver water from the tributary 122 the drain 110 is caused by the reduction in pressure at the outlet end 42 of the pipe 40 due to the action of the pump when the level of the water, and its concomitant flow in the drain 110 is above the height of the pump 10. The flood barrier 100 is mounted on a foundation 108 as part of a conventional flood defense extending, for example up and down river forming a boundary of the drain 110.

Figure 3:
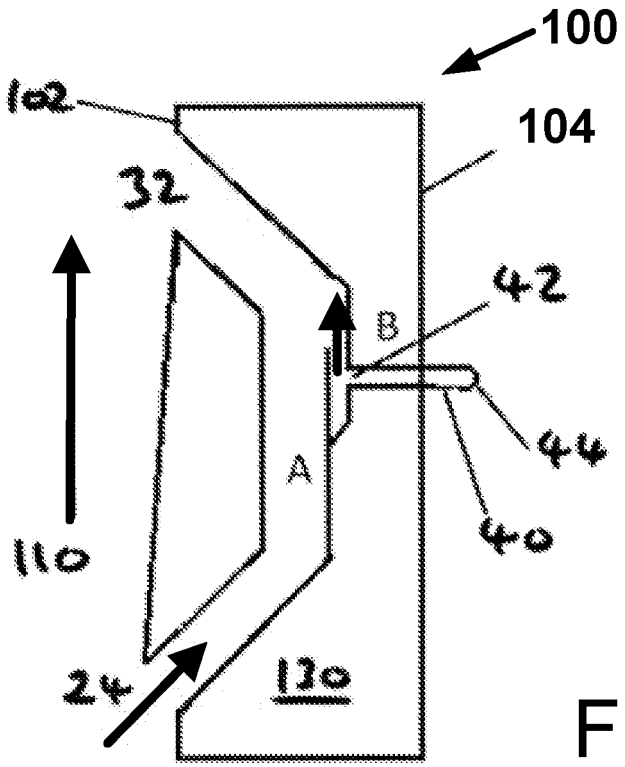
FIG. 3 shows a cross-section in the horizontal plane through an embodiment of the present invention.

FIG. 3 shows a cross-section in the horizontal plane through an embodiment of the present invention; the features of this embodiment are as described for the previous embodiments, with the overall conduit 24 to 32 comprising the inlet conduit 20, the outlet conduit 30 and the overlapping region within the pump 10. As can be seen the inlet of the inlet conduit is angled relative to the first face of the flood barrier and as such this facilitates water ingress whilst, in a preferable configuration were a screen is placed over that inlet the angle provides self-cleaning of the screen. The outlet 22 of the inlet conduit 20 overlaps with the inlet 34 of the outlet conduit 30 and provides a region into which the outlet ends of the pipe 42 feeds, that region being at a lower pressure due to the expansion of the water from the inlet conduit to the outlet conduit.

Figure 4:
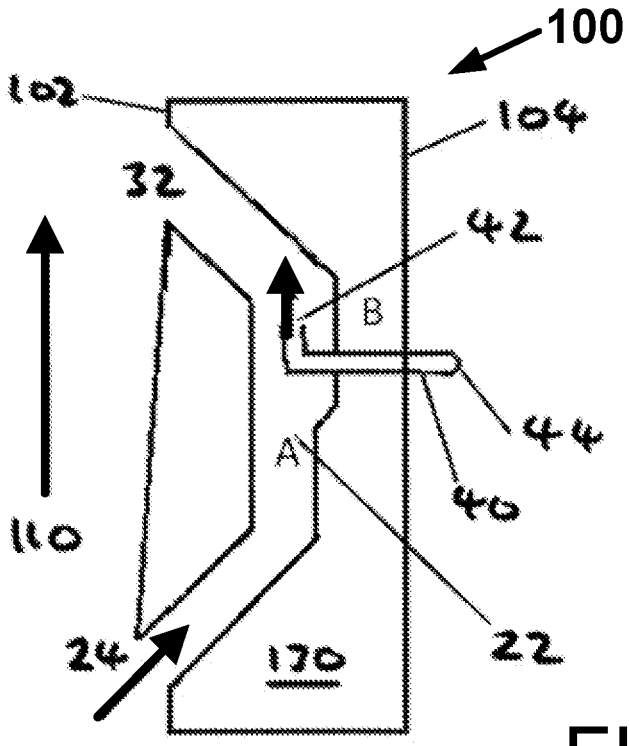
FIG. 4 shows a cross-section in the horizontal plane through a variation on an embodiment of the present invention.

FIG. 4 shows a cross-section in the horizontal plane through a variation on an embodiment of the present invention; FIG. 4 is substantially as described regarding FIG. 3 but with the variation that the outlet 22 of the inlet conduit 20 terminates at the inlet of the outlet conduit and in this region the outlet 42 of the pipe 40 extends so as to make effective use of the reduced pressure in that region. Although, as previous dimensioned this leaves the end 42 of the pipe 40 exposed and so the efficiency is offset by the potential for damage. An alternative is that the pipe 40 may have its outlet 42 terminated on the wall of the region proximate to the inlet 34 of the outlet conduit 30, this is less efficient but does avoid blockage. As will be appreciated that different variations in pump configuration and offer optimisation depending upon the particular circumstances in terms of water flow rate in the drain, a high rate giving high-efficiency which can enable lower efficiency pump configurations to be viable, such as to cope with situations were a high level of detritus is expected. Similarly, in situations where a low level of detritus is expected (such as in lower flow rate and less turbulent grains) then more efficient suction may be provided. The features of high efficiency and high protection can be achieved by the combination with the angled inlet screen, which reduces detritus ingress and has a degree of self-cleaning. These features may be combined with a tapered pipe and or conduit(s) to further reduce the potential for blockage.

Figure 5:
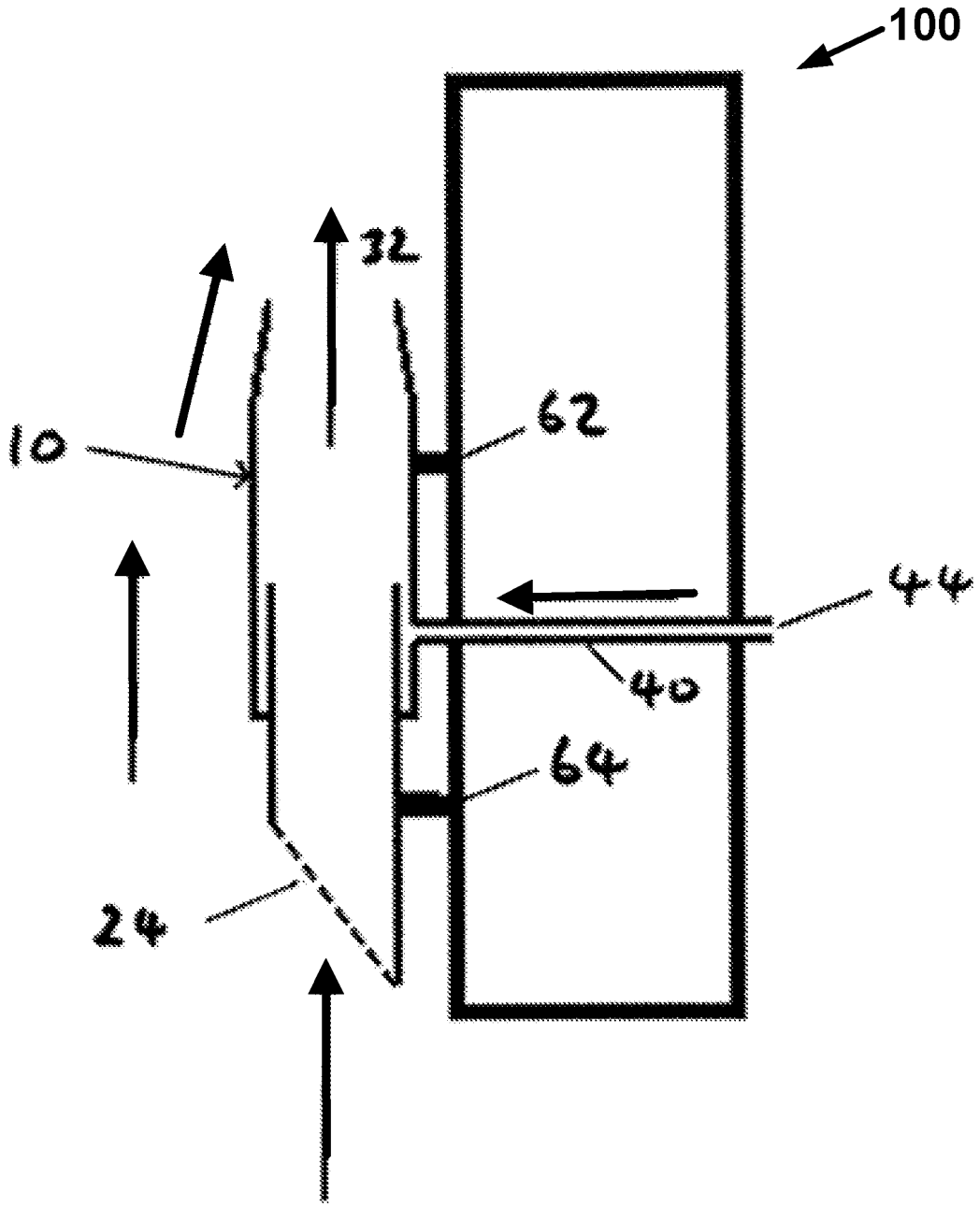
FIG. 5 shows a horizontal cross-section through a further embodiment of the present invention analogous to that shown in FIG. 2.

FIG. 5 shows a horizontal cross-section through a further embodiment of the present invention analogous to that shown in FIG. 2. In this embodiment the pump is mounted outside of the main body of the flood defense 100 with its first and second walls (being identified as in previous diagrams), the pump being affixed, such as is suitable for a retrofit by means of supports (62, 64) fore and aft of the pipe 40 to the wall. A first support attached to the inlet conduit and the $2^{nd}$ support being attached the outlet conduit. In this embodiment the inlet of the inlet conduit 22 is angled and carries a screen, this configuration has the advantage that unlike the conduit being located within the main body of the flood defense 100 (i.e. between the first and $2^{nd}$ walls) that there is no reduction in water flow due to angling of the conduit. The self-cleaning effect is maintained. This, in the FIG. 5, combined with an outlet 32 of the outlet conduit 30 in which the outlet is a constriction and this in itself gives a degree of reduced pressure at the outlet due to the surrounding drain water passing by on the outside, thus giving two regions of reduced pressure, that at the exit of the first conduit 24 and at the exit of the second conduit 34. As shown here the pipe 40 leads directly through the body of the flood defense 100, but it may equally well do so in a preferred upward loop as previously described. The features of the inlet of the inlet conduit and the outlet of the outlet conduit may be used independently or together in this embodiment. The combination is preferred.

Figure 6A:
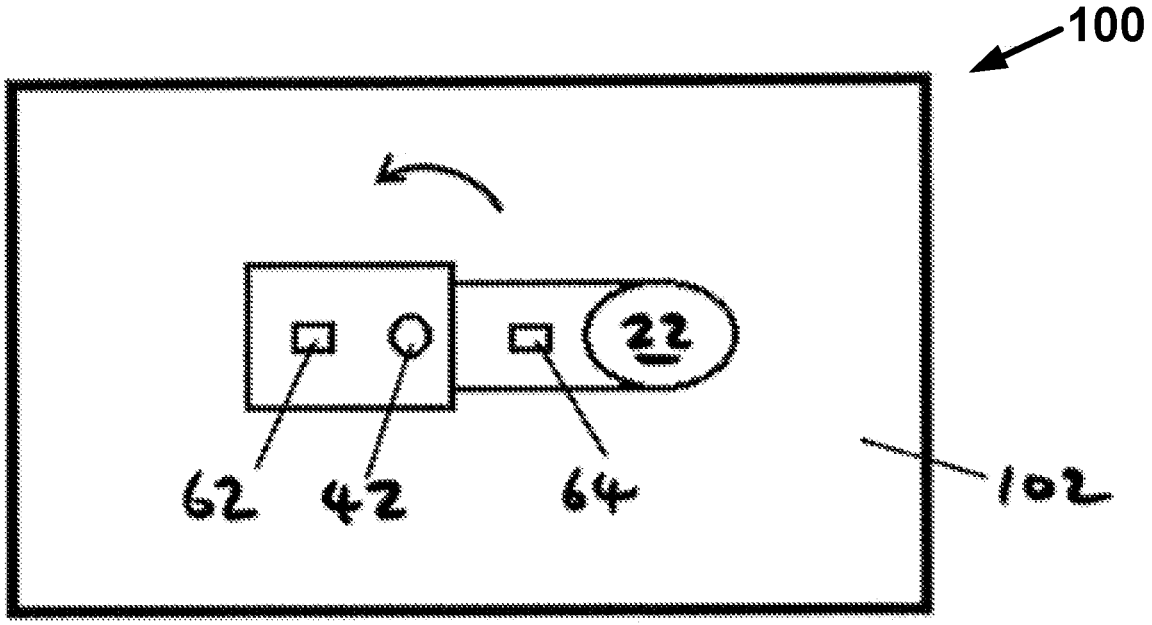
FIG. 6A and FIG. 6B show a side view, facing the first face of the present invention analogous to FIG. 5, in which rotation of the pump to face in an opposite direction is demonstrated.
Figure 6B:
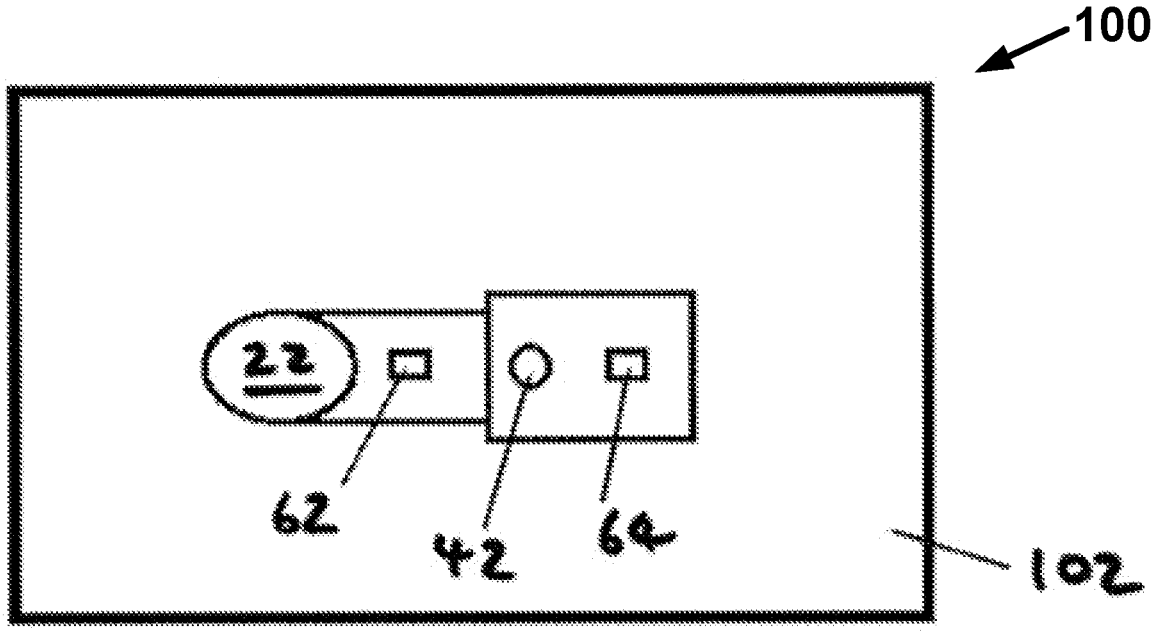

A variation on this embodiment is shown in side view in FIG. 6A and FIG. 6B. Here the pipe 40 is a fulcrum at its exit 42 and the pump is rotatable about that fulcrum and secured by supports (62, 64) symmetrically placed about the fulcrum, such as using bolts. (Note outlet 42 of the pipe is behind the plane of the paper, c.f. FIG. 5, but is shown as a circle for clarity) The pump is then rotatable to face in either direction relative to the first face of the barrier. Hence, different water flow directions can still be used to power the pump. This is particularly useful when the barrier is portable and may needed to be placed port or starboard of a drain, such a river on installation. Rather than only on the side which has the correct flow direction, which may not be practicable.

In the various embodiment the longitudinal axis of the overall conduit may be horizontal. Similarly, the inlet 24 and outlet 32 apertures may both be positioned at the same height from the base of the flood barrier.

In the FIGS. 2 to 5 the wall 130 is shown in cross section in but is not shown hatched as is conventional, for clarity. Hence whilst the wall 130 may be hollow forming an internal area (volume), such as for lighter transport and being filled with water in situ for ballast it may also be solid, particularly when not intended to be portable. The wall when hollow is preferably constructed of steel for rigidity, when solid it is preferably constructed of concrete. A solid portable wall may be sheet steel, so without appreciable thickness but not hollow.

When water ballast is used inlets 140, 142 may be provided and 142, the lower being, an outlet for emptying for transportation after use. 142 may be a one-way valve to allow self-filling up to a level of surrounding water so speeding filling. The internal area may be configured to act as a portion of pipe 40 to enable further filling when 140 and 142 (140 only when 142 is a one-way valve) are sealed.

As explained, a flood barrier for protecting the environment can have a venturi type effect pumping means not requiring external power, the flood barrier comprising a wall and a pump for drawing water across the barrier from a first side to a second side. The wall configured to provide a barrier preventing movement of water from the first, drain, side to the second, tributary, side, of that wall. A suitable drain is a river or other water course with flowing water. The barrier further comprising a pipe traversing the wall for transferring water between the two sides of the wall the pipe being terminated in the first side of the wall at a venturi effect pump, the pump being feedable with water from the drain through a conduit inlet so as to create suction in the pipe for drawing water through the pipe from the second side of the wall to drain water from the second to the first side of the wall.

It will be appreciated that many of the features of the invention may be combinable even if not explicitly described in combination. For example, a hollow ballasted wall with tapered conduits.

What is claimed is:

1. A flood barrier (100) comprising:

a wall (130); and a venturi effect pump (10) for drawing water from a second side (104) of the wall to a first side (102) of the wall, the wall configured to provide a barrier preventing movement of water from the first side of the wall to the second side of the wall, wherein the barrier further comprises a pipe (40) traversing the wall for transferring water between the first side of the wall and the second side of the wall, the pipe being terminated in the first side of the wall at the venturi effect pump, the venturi effect pump being feedable with water at the first side of the wall through a conduit inlet (22) so as to create suction in the pipe for drawing water through the pipe from the second side of the wall to drain water from the second side of the wall to the first side of the wall, wherein the wall is hollow and an internal area so present is configured to be filled with water to ballast the wall, wherein the internal area is configured to act as a portion of the pipe, and wherein the pipe is so configured by means of a valve or valves so as to allow the pipe to be closed from the internal area when a fill level of the internal area has been achieved.

2. The flood barrier of claim 1, wherein the pipe traversing in the wall, an inlet conduit to the pump, which is larger than the pipe, and an outlet conduit from the pump, which is larger than the inlet conduit, do not have any constrictions and there is no constriction within the venturi effect pump between the inlet conduit and the outlet conduit.

3. The flood barrier of claim 1, wherein one or more of the pipe, an inlet conduit and an outlet conduit taper outward from respective inlet to outlet ends.

4. The flood barrier of claim 1, wherein the first side and the second side are separated by an internal area; the first side of the wall defines at least one pair of ports; and an overall conduit extends between each of the at least one pair of ports; wherein the overall conduit is housed within the internal area and the venturi pump is housed within the conduit.

5. The flood barrier of claim 1, wherein a first face of the first side of the wall has a sealable aperture (142) on a lower side portion for filling of water for ballasting the wall.

6. The flood barrier of claim 5, wherein the sealable aperture is a one-way valve for allowing water to enter but not, without actuating an optional release, allowing water to exit the internal area.

* * * * *